US005890320A

United States Patent [19]

Andersen

[11] Patent Number: 5,890,320

[45] Date of Patent: Apr. 6, 1999

[54] BARRIER GATE ESPECIALLY FOR SMALL CHILDREN

[76] Inventor: Finn Andersen, Niels Bohrsvej 14, Läsby, Denmark, 8670

[21] Appl. No.: 793,456

[22] PCT Filed: Aug. 28, 1995

[86] PCT No.: PCT/DK95/00346

§ 371 Date: Feb. 26, 1997

§ 102(e) Date: Feb. 26, 1997

[87] PCT Pub. No.: WO96/07008

PCT Pub. Date: Mar. 7, 1996

[30] Foreign Application Priority Data

Aug. 26, 1994 [DK] Denmark ..... 0987/94

[51] Int. Cl.[6] ..... E05C 21/02

[52] U.S. Cl. ..... 49/465; 49/463

[58] Field of Search ..... 49/463, 465, 394, 49/50, 56; 292/175

[56] References Cited

U.S. PATENT DOCUMENTS

| | | | |
|---|---|---|---|
| 2,392,874 | 1/1946 | Delaez | 49/463 X |
| 2,668,729 | 2/1954 | Watters | 49/50 X |
| 3,476,427 | 11/1969 | Kittelson | 292/175 |
| 4,677,789 | 7/1987 | Merry | 49/56 |
| 5,272,840 | 12/1993 | Knoeller . | |

FOREIGN PATENT DOCUMENTS

| | | | |
|---|---|---|---|
| 2650014 | 1/1991 | France | 49/50 |
| 2010164 | 12/1990 | United Kingdom . | |
| 2267725 | 12/1993 | United Kingdom . | |
| 2271603 | 4/1994 | United Kingdom . | |
| 2026253 | 12/1994 | United Kingdom . | |
| 2294080 | 4/1996 | United Kingdom . | |

*Primary Examiner*—Jerry Redman
*Attorney, Agent, or Firm*—Watson Cole Grindle; Watson, P.L.L.C.

[57] ABSTRACT

A temporary barrier for an opening includes a frame which is securable in the opening and a gate which is connected to the frame to swing open and closed, the gate including a manually activatable locking device which can include an inverted U-shaped housing that straddles an upper member of the gate, an operating handle that is positioned beneath the upper member and between sides of the U-shaped housing, and a lock bar which extends downwardly from the operating handle to cooperate with a part of the frame to lock or unlock the gate relative to the frame, the operating handle being biased downwardly by springs.

10 Claims, 2 Drawing Sheets

BARRIER GATE ESPECIALLY FOR SMALL CHILDREN

BACKGROUND OF THE INVENTION

1. Field of the Invention

The present invention relates to a barrier gate of the type, that includes a frame which is secured in an opening such as a doorway or a staircase so as to seal off the opening, and an openable gate with a locking mounted in the frame for locking the gate in a closed position.

2. The Prior Art

An example of such a child safety gate is known from GB-A 2 226 845. A disadvantage is that the lower corner of the gate is not fixed in the locking position and Is deflectable.

SUMMARY OF THE INVENTION

This problem is solved by a child safety gate according to the invention which includes a locking member with an operation handle at the upper member of the gate for the activation of an engaging part at the lower member of the gate, the engaging part being designed for engaging the lower member of the gate which is designed for receiving the engaging part. Hereby a safe fixation of the lowermost corner of the gate is obtained. It is understood that of necessity other looking devices can be fixed to the top corner of the gate, e.g., activated through the same operation handle.

In a simple manner the locking device is designed with an operation handle which is downwardly loaded with a spring, i.e., when opening the gate it is to be pulled upwards. This ensures an easy handling for adults combined with it being a difficult movement, if not even an impossible one, for small children to operate. At the same time it is possible to provide an extra security through a heavy spring load, which only can be overcome by an adult person.

The locking device is preferably fixed to the upper member of the gate, with the operation handle below the member and at a distance such that an adult person, with the palm of his hand on the upper member, can nevertheless reach below the operation handle and activate it with his fingers. This results in an operation that is easy to accomplish and a simple construction.

The engaging part is in a particularly simple manner formed at the end of a bar connected to the operation handle and where the end extends through the introduction in the upper member of the gate and can go into a locking engagement with a lock hole on the top side of the lower member of the gate frame. Hereby a safe locking of the lowermost corner of the gate is achieved.

In order to unload or as a stop for the operation handle, the bar is designed with a stopping means for co-operation with the top side of the lower member of the gate frame for determination of the extreme position of the bar. This gives a simple construction as the operation handle in this case does not need to be designed with proper stops.

Alternatively, the engaging part can be shaped as a fork fitting that grips around the top side of the lower member of the frame, which also provides a safe fixation.

A particularly simple embodiment is achieved by forming the fork fitting so that it also grips around the lower member of the gate and is guided thereon. Hereby extra equipment for guiding the fitting is avoided.

The connection between the operation handle and the engaging parts does not necessarily have to be a rigid connection, but could be a wire, a string, a strap or the like, and that the engaging part is spring-loadedly arranged for locking engagement in the lower member of the gate. In such a case the guidance is suitably hidden away in a tube with a view to the child's safety.

A particularly preferred embodiment of the locking device includes a U-shaped part fixed straddling on the upper member of the gate, and the operation handle extends up between the sides of the U-shaped part, and a spring means is placed between the lower side of the upper member of the gate and the top side of the operation handle. This construction is simple and easy to mount and easy to operate but foremost child proof.

In barrier gates of the type where a fixed grid piece is present at each side of the gate, the operation handle can be designed in a U-shape with an elongation beyond the front edge of the gate intended for engagement across the top side of the upper member of the gate frame for providing a locking engagement therewith. Hereby, a fixation of the top corner of the gate is obtained as well. The fixation can be further improved in that the elongated part furthermore is provided with a dowel for engagement with a hole on the top side of the upper member of the gate frame.

The invention will in the following be further explained with reference to the accompanying drawing that exclusively displays the essential parts for the understanding of the invention.

In the drawings:

DETAILED DESCRIPTION OF THE PREFERRED EMBODIMENTS

Figure 1:
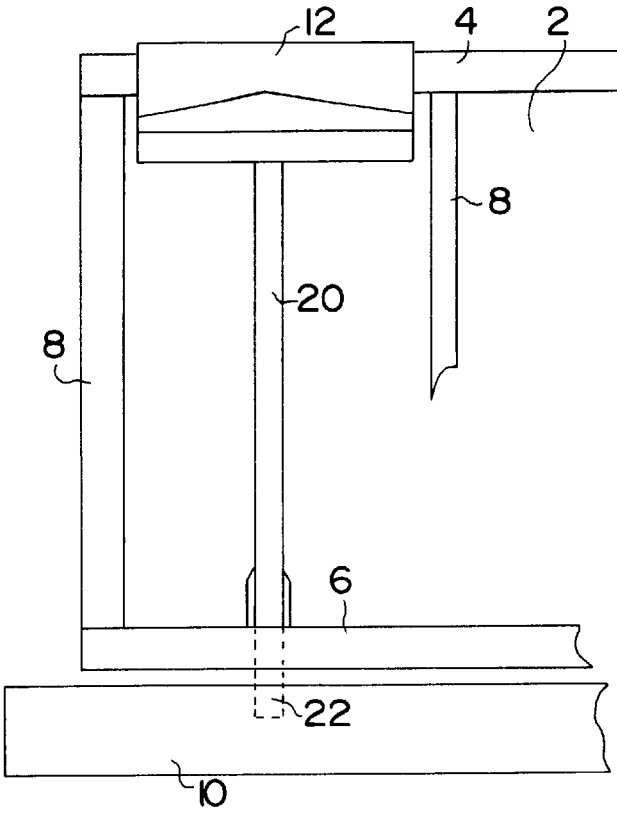
FIG. 1 shows a section of the front end of a first embodiment of the gate.
Figure 2:
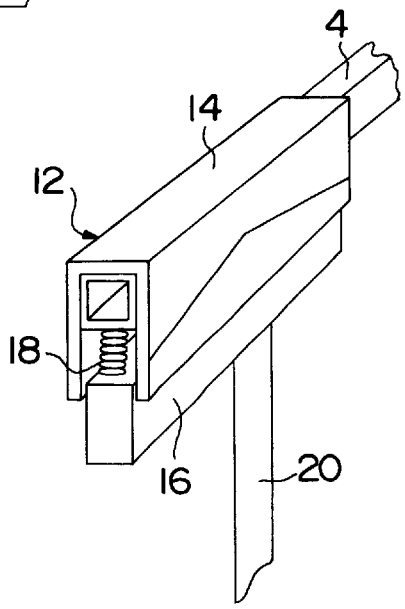
FIG. 2 shows a perspective view of the handle.

In the figures a gate is displayed where a number of gate bars 8 extend between an upper member 4 and a lower member 6. The gate is hinged to the frame at the side that is not shown in the drawing. The lower member of the frame is shown by the reference number 10.

The locking device of the gate comprises a handle 12, which consists of a U-shaped top part 14 that is placed on the upper member 4 of the gate and that extends beyond the member 4. Below the upper member 4 an underpart 16 is placed in the top part 14. This underpart 16 is slidably placed in the top part 14 and loaded by spring 18 to an extreme position, i.e., downwards. The spring-load could be provided by coil springs, but most suitably a leaf spring is used. To the underpart a bar 20 is connected that also functions as a gate bar. The end of the bar is formed as a fork fitting 22 that grips around the lower member of the gate and extends down on the side of the lower member of the frame, and through this locks the lower corner of the gate in a closed position. In the plane of the gate the bar 22 could be provided with not shown side guiding projections on the lower member of the gate.

Instead of the fork fitting the bar can extend through a hole in the lower member of the gate and down in an underlying hole in the lower member of the frame, whereby a locking effect is achieved.

Figure 3:
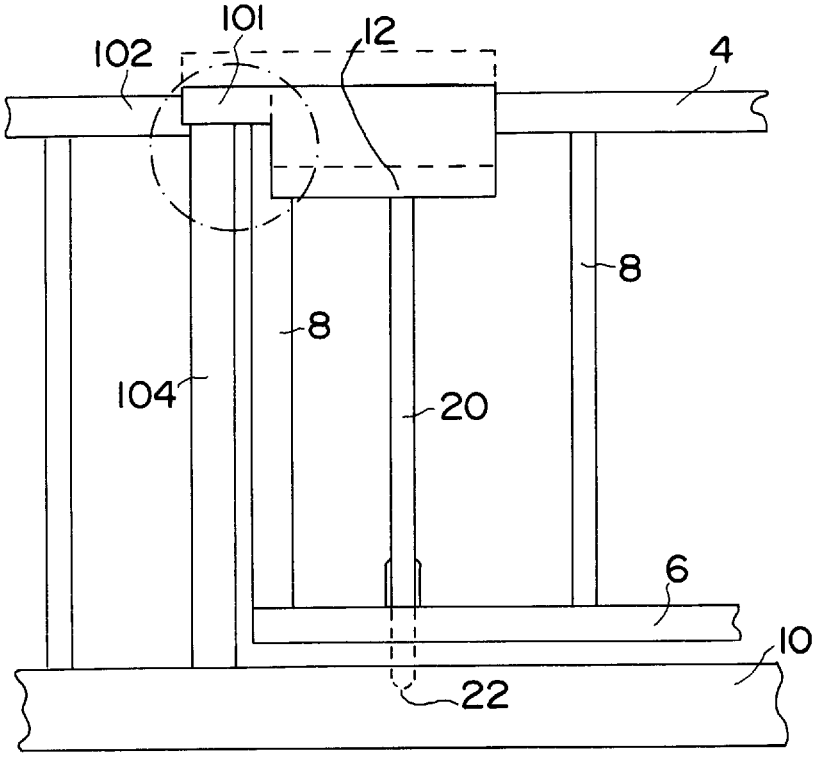
FIG. 3 shows a section at the front end of a second embodiment of the gate according to the invention.
Figure 3A:
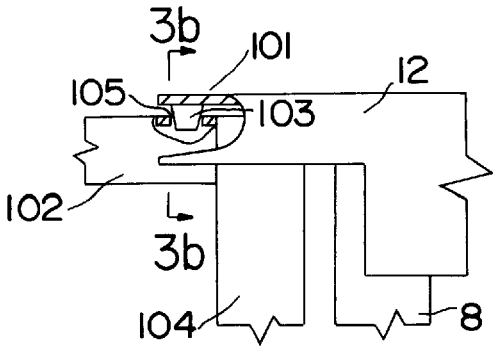
Figure 3B:
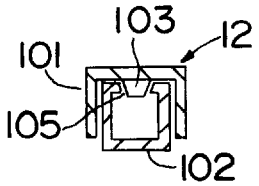
Figure 3C:
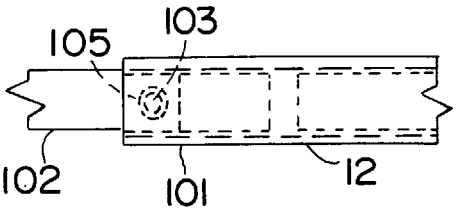

In FIG. 3 a second embodiment of the gate according to the invention is shown where the handle 12 has an extension for engaging the top side of the upper member on the gate that here is of the type where both sides of the gate have a grid piece. The handle is loosely placed on the upper member of the gate, but is otherwise spring-loaded as before, as the handle has a bottom piece where the bar 20 is connected to. The spring is provided between the bottom piece and the lower side of the upper member of the gate in such a way that the handle is held down by the spring force. By pulling the handle as a whole upwards to the position indicated in dotted lines, the locking engagement is released, as the bar is pulled up from the lower member and the extension of the handle is lifted free from the upper member.

By the invention a simple locking mechanism is thus provided that in the locked position of the gate simultaneously fixes the lower corner of said gate.

I claim:

1. A child barrier for temporary barring of an opening by insertion and securing of the barrier in the opening, said child barrier comprising:

a frame which is securable in the opening and which includes a lower member having a lock hole on a top side thereof, and a gate which is hinged to said frame so as to swing relative to said frame to open and close said opening, said gate having an upper member, a lower member having a hole therethrough, and a lock device having an operating handle at said upper member and a lock bar extending from said operating handle to said lower member and longitudinally movable by said operating handle to move through said hole in said lower member of the gate to enable an end part of said lock bar to lockingly engage in the lock hole of the lower member of said frame.

2. A child barrier according to claim 1, wherein said lock bar includes stop means for cooperating with the lower member of said gate to determine an extreme lower positioning of said lock bar.

3. A child barrier according to claim 1, wherein said gate includes a plurality of gate bars which extend between said upper member and said lower member thereof, said lock bar functioning as one of said gate bars.

4. A safety barrier for temporary insertion in an opening to prevent passage of a person or animal through the opening, said safety barrier comprising:

a frame which is securable in the opening and which includes a substantially horizontal lower member, a gate which has one end hinged to said frame so that an opposite free end can swing relative to said frame to open and close said opening, said gate comprising an upper member, a lower member, and a locking device, said locking device including an inverted U-shaped housing straddling said upper member, an operating handle positioned beneath said upper member and between sides of said U-shaped housing, a spring means located between the operating handle and the upper member to bias said operating handle downwardly relative to said upper member, and a lock bar which extends downwardly from said operating handle to move longitudinally based on movement of said operating handle relative to said upper member, a lower end of said lock bar being movable downwardly to lock the free end of said gate to said frame and close said opening when said operating handle is biased by said spring means downwardly relative to said upper member, and upwardly to unlock the free end of said gate relative to said frame when said operating handle is manually moved upwardly relative to said upper member.

5. A safety barrier according to claim 4, wherein said lock bar includes stop means for cooperation with said lower member of said gate to determine an extreme lower positioning of said lock bar.

6. A safety barrier according to claim 4, including a fork means at said lower end of said lock bar for straddling a top of the lower member of said frame to lock said gate in position.

7. A safety barrier for temporary insertion in an opening to prevent passage through the opening of a person or animal, said safety barrier comprising:

a frame which is securable in the opening and which includes an upper member and a substantially horizontal lower member, a gate which has one end hinged to said frame so that an opposite free end can swing relative to said frame to open and close said opening, said gate comprising an upper member, a lower member, a side member, and a locking device, said locking device including a U-shaped operating handle which straddles said upper member of said gate and is movably mounted relative thereto, said operating handle extending beyond said side member to engage with a top side of the upper member of said frame for locking engagement therewith, and a lock bar which extends downwardly from said operating handle to move longitudinally based on movement of said operating handle relative to said upper member, a lower end of said lock bar being movable downwardly to lock the free end of said gate to said frame and close said opening when said operating handle is biased by said spring means downwardly relative to said upper member, and upwardly to unlock the free end of said gate relative to said frame when said operating handle is manually moved upwardly relative to said upper member.

8. A safety barrier according to claim 7, wherein said lock bar includes stop means for cooperation with said lower member of said gate to determine an extreme lower positioning of said lock bar.

9. A safety barrier according to claim 7, including a fork means at said lower end of said lock bar for straddling a top of the lower member of said frame to lock said gate in position.

10. A safety barrier according to claim 7, wherein said upper member of said frame includes a hole and wherein said operating member includes a dowel which fits in said hole when said operating member engages with the top side of said upper member of said frame.

* * * * *